US007998275B2

(12) United States Patent
Frey et al.

(10) Patent No.: US 7,998,275 B2
(45) Date of Patent: Aug. 16, 2011

(54) METHOD FOR CLEANING A CIRCUMFERENTIAL SURFACE OF A CYLINDER OF A PRINTING PRESS

(75) Inventors: Jörg Frey, Angelbachtal (DE); Jörg Heuschkel, Viernheim (DE); Bernd Maier, Mannheim (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 12/391,661

(22) Filed: Feb. 24, 2009

(65) Prior Publication Data

US 2009/0211599 A1 Aug. 27, 2009

(30) Foreign Application Priority Data

Feb. 26, 2008 (DE) ..... 10 2008 011 053

(51) Int. Cl.
*B08B 3/04* (2006.01)

(52) U.S. Cl. ..... 134/6; 134/40; 134/42; 101/424; 101/483; 399/343; 399/345; 399/347; 399/353; 15/256.51; 15/256.52

(58) Field of Classification Search ..... 134/6, 40, 134/42; 101/483, 424; 399/343, 345, 347, 399/353; 15/256.51, 256.52
See application file for complete search history.

(56) References Cited

U.S. PATENT DOCUMENTS

| | | | | |
|---|---|---|---|---|
| 4,022,125 | A * | 5/1977 | Weaver | 101/148 |
| 4,066,017 | A * | 1/1978 | Garcowski et al. | 101/425 |
| 4,311,095 | A * | 1/1982 | Jeschke | 101/425 |
| 4,676,157 | A * | 6/1987 | Ichikawa et al. | 101/155 |
| 4,724,764 | A * | 2/1988 | MacPhee et al. | 101/451 |
| 4,757,763 | A * | 7/1988 | MacPhee et al. | 101/425 |
| 5,174,209 | A * | 12/1992 | Rodi et al. | 101/424 |
| 5,331,891 | A * | 7/1994 | Sugiyama et al. | 101/424 |
| 5,375,522 | A * | 12/1994 | Junghans | 101/424 |
| 5,447,102 | A * | 9/1995 | Pfeiffer et al. | 101/492 |
| 5,566,617 | A | 10/1996 | Durrnagel | |
| 5,974,975 | A * | 11/1999 | Seefried | 101/424 |
| 6,588,337 | B1 * | 7/2003 | Kreckel et al. | 101/424 |
| 7,373,882 | B2 * | 5/2008 | Heuschkel et al. | 101/483 |
| 2002/0023665 | A1 * | 2/2002 | Corti et al. | 134/6 |
| 2004/0163561 | A1 * | 8/2004 | Yokoyama | 101/425 |
| 2005/0061182 | A1 | 3/2005 | Ebina et al. | |

(Continued)

FOREIGN PATENT DOCUMENTS

DE 19843363 A1 3/2000

(Continued)

OTHER PUBLICATIONS

Merriam Webster's Collegiate Dictionary, Tenth Edition, 1994, p. 292.*

(Continued)

*Primary Examiner* — Sharidan Carrillo
(74) *Attorney, Agent, or Firm* — Laurence A. Greenberg; Werner H. Stemer; Ralph E. Locher

(57) ABSTRACT

A method for cleaning a circumferential surface of a cylinder of a printing press provides for improved cleaning to be achieved during a short time. In order to clean the circumferential surface, a cleaning fluid is first applied to the circumferential surface. In order then to remove contaminants, the contaminants a broken up mechanically after the cleaning fluid is applied and before a cleaning apparatus acting on the circumferential surface is set into operation.

9 Claims, 2 Drawing Sheets

U.S. PATENT DOCUMENTS

| | | | | |
|---|---|---|---|---|
| 2006/0032389 | A1 | 2/2006 | Telljohann | |
| 2006/0117977 | A1 | 6/2006 | Vestman et al. | |
| 2006/0130680 | A1* | 6/2006 | Heuschkel et al. | 101/148 |
| 2007/0012205 | A1* | 1/2007 | Chevalier et al. | 101/226 |
| 2008/0017059 | A1* | 1/2008 | Englram et al. | 101/364 |

FOREIGN PATENT DOCUMENTS

| | | | |
|---|---|---|---|
| DE | 10252013 | A1 | 5/2004 |
| DE | 10355909 | A1 | 6/2005 |
| DE | 102005062373 | A1 | 6/2007 |
| EP | 0709191 | A1 | 5/1996 |
| EP | 1516730 | A1 | 3/2005 |
| EP | 1661702 | B1 | 5/2006 |
| WO | 2007073851 | A1 | 7/2007 |

OTHER PUBLICATIONS

Thibault, Leo. "Fountain Solution Chemistry", 2007-2008, graphic arts magazine, pp. 1-2.*

* cited by examiner

METHOD FOR CLEANING A CIRCUMFERENTIAL SURFACE OF A CYLINDER OF A PRINTING PRESS

CROSS-REFERENCE TO RELATED APPLICATION

This application claims the priority, under 35 U.S.C. §119, of German application DE 10 2008 011 053.1, filed Feb. 26, 2008; the prior application is herewith incorporated by reference in its entirety.

BACKGROUND OF THE INVENTION

Field of the Invention

The invention relates to a method for cleaning a circumferential surface of a cylinder of a printing press, in which a cleaning fluid is applied to the circumferential surface, and in which, in order to remove contaminants, a cleaning apparatus that acts on the circumferential surface is set into operation.

In order to clean a circumferential surface of a cylinder of a press, it is known to use cloth washing devices and/or brush washing devices. A washing device can be assigned to just one cylinder or is used as a combined washing device for a number of cylinders.

During printing in offset printing, printing ink is transferred from a printing form to the surface of a rubber blanket. In a press nip between a blanket cylinder and an impression cylinder, the printing ink is transferred to a sheet or a web in accordance with an image. During printing, in the regions where the marginal edges of the printing material are located, paper edge streaks are deposited on the rubber blanket. The paper edge streaks are composed of paper particles and printing ink, which represent undesired stubborn contaminants of the blanket. If these contaminants are not eliminated, the surface of the adjacent impression cylinder can be damaged, so that wear marks are produced, which result in printing defects.

In order to wash the blanket, it is known to use a washing device which acts on the surface of the blanket by means of brushes and a liquid washing agent. Following the cleaning of the blanket, the surface of the adjacent impression cylinder can be cleaned by the blanket cylinder being thrown on to the impression cylinder. As the cylinders rotate, the printing ink to be removed from the impression cylinder, including contaminants, is transferred to the blanket and removed by the blanket washing device. In order to eliminate paper edge streaks from the blanket, the washing operation is carried out over a relatively long time, so that the productivity of the press is undesirably reduced.

European patent EP 1 661 702 B1 and its counterpart U.S. published patent application US 2006/0117977 A1 disclose methods of cleaning cylinders of a press in which the cleaning action is controlled as a function of the level of contamination. To this end, the level of contamination on the circumferential surface of a cylinder is registered continuously by a camera.

In a method for cleaning the circumferential surface of a cylinder of a press according to U.S. patent application publication US 2005/0061182 A1 and its European counterpart EP 1 516 730 A1, various cleaning parameters can be preset as a function of the type of contamination. Adjustable parameters are, amongst others, the quantity and the duration of action of a detergent to be fed to a washing cloth.

German published patent application DE 10 2005 062 373 A1 and international PCT application WO 2007/073951 A1 show a sheetfed offset press in which, for the purpose of cleaning, detergent is sprayed onto inking rolls and is distributed by rotation of the rolls. After an emulsion of printing ink and detergent has been formed, a doctor device, which doctors off the emulsion, is thrown on to one of the inking rolls.

In a cleaning apparatus for a blanket cylinder of a wet offset press according to DE 103 55 909 A1, a brush or a washing cloth is used, washing agent or the dampening solution used during printing optionally being used for a cleaning operation. The dampening solution used for the cleaning is branched off from the dampening solution flow existing during printing.

SUMMARY OF THE INVENTION

It is accordingly an object of the invention to provide a method for cleaning a circumferential surface of a cylinder of a press which overcomes the above-mentioned disadvantages of the heretofore-known devices and methods of this general type and which provides for improved cleaning action during shorter processing times.

With the foregoing and other objects in view there is provided, in accordance with the invention, a method for cleaning a circumferential surface of a cylinder in a printing press, the method which comprises:

- applying a cleaning fluid to the circumferential surface of the cylinder;
- subsequently removing contaminants from the circumferential surface by:
  - mechanically breaking up the contaminants; and
  - subsequently starting into operation a cleaning apparatus acting on the circumferential surface.

In other words, according to the invention, for the purpose of cleaning first of all a cleaning fluid is applied to the circumferential surface of a cylinder, after that the contaminants are broken up mechanically and ultimately removed from the circumferential surface by a cleaning apparatus.

During the cleaning of the circumferential surface of a transfer cylinder of a wet offset press, dampening solution can be applied as a cleaning fluid by an adjacent printing form cylinder being thrown on to the transfer cylinder and at least one dampening solution applicator roll being thrown on to the printing form cylinder. During a rotation of the printing form cylinder and the transfer cylinder and of the dampening solution applicator roll, dampening solution is applied to the circumferential surface. Breaking up contaminants, in particular paper edge streaks, on the circumferential surface of the transfer cylinder is carried out as a result of the pressure exerted on the circumferential surface by the printing form cylinder.

Alternatively, a rotatable breaker roll can be thrown on to the transfer cylinder. The breaker roll preferably has a smaller diameter than the transfer cylinder and has a hard surface. The action of the breaker roll can be increased if the surface is structured. Suitable surface materials for the breaker roll are, among others, chromium or ceramic.

Furthermore, the cleaning fluid can alternatively be applied to the circumferential surface by using an additional apparatus. It is possible to apply dampening solution on its own or to apply a specific cleaning fluid which penetrates paper edge streaks particularly well.

The improved cleaning action occurs as a result of the combined action of the cleaning fluid and the pressure of the printing form cylinder or the breaker roll on the contaminants.

Other features which are considered as characteristic for the invention are set forth in the appended claims.

Although the invention is illustrated and described herein as embodied in a method for cleaning a circumferential surface of a cylinder of a printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
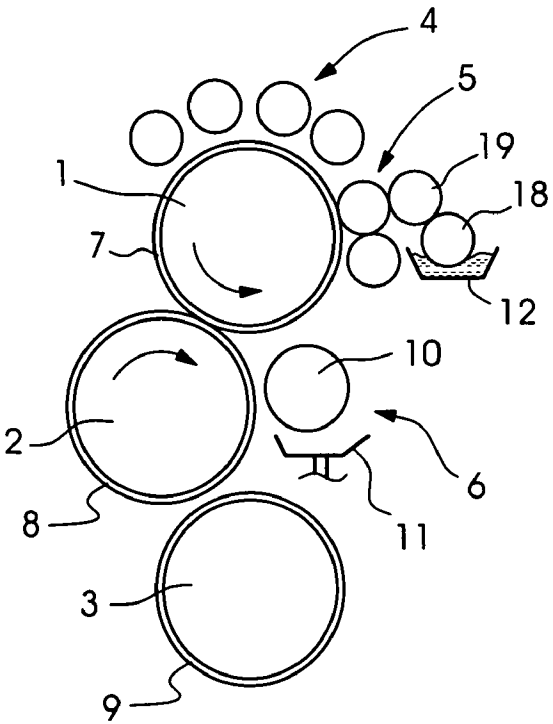
FIGS. 1-3 show a schematic side view of a printing unit of a wet offset press in three different cleaning configurations.
Figure 2:
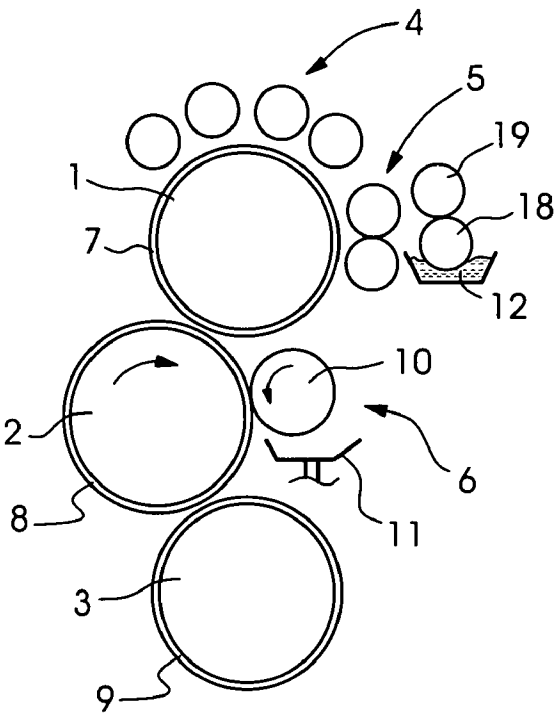
Figure 3:
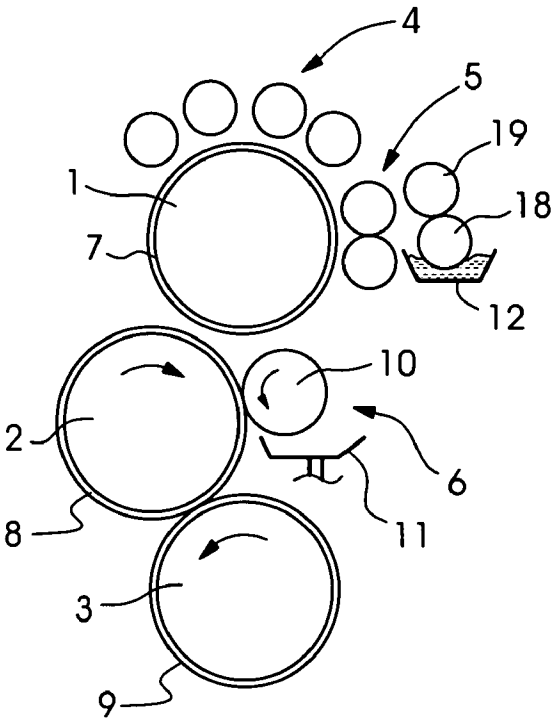

Referring now to the figures of the drawing in detail and first, particularly, to FIGS. 1-3 thereof, the illustration pertains to a printing unit of a wet offset press. The printing unit comprises, inter alia, a plate cylinder 1, a blanket cylinder 2, an impression cylinder 3, ink applicator rolls 4, dampening solution applicator rolls 5, and a brush cleaning apparatus 6. A printing plate 7 is stretched on the body of the drum of the plate cylinder 1. A resilient rubber blanket 8 is drawn onto the body of the drum of the blanket cylinder 2. The body of the drum of the impression cylinder 3 bears a cover 9 that repels printing ink. The cylinders 1-3 are held in side walls of the press and are mounted such that they can be rotated in the direction of the arrows by a drive. The drive may be implemented via a gear mechanism or by means of individual drives. The blanket cylinder 2 can be thrown on to the plate cylinder 1 or on to the impression cylinder 3 or on to the plate cylinder and the impression cylinder 3 simultaneously as desired, by a corresponding apparatus. The cleaning apparatus 6 contains a rotatable brush 10, which can be thrown on to and off the blanket 8 by a corresponding apparatus. The brush 10 is assigned a doctor trough 11. The ink applicator rolls 4 and the dampening solution applicator rolls 5 can in each case be thrown on to and off the printing form 7, again by a corresponding apparatus.

During printing, the blanket cylinder 2 is thrown on to the plate cylinder 1 and the impression cylinder 3. Furthermore, during printing the ink applicator rolls 4 and the dampening solution applicator rolls are thrown on to the plate cylinder 1. During the rotation of the cylinders 1-3 in the direction of the arrows, dampening solution/fountain solution from a storage container 12 and printing ink from an ink fountain are applied to the printing plate 7. The printing ink is transferred to the blanket 8 in accordance with an image. During printing, a sheet 13 (cf. FIG. 4) is carried on the impression cylinder 3. The printing ink 14 is transferred from the circumferential surface 15 of the blanket cylinder 2 to the surface of the sheet 13. The cover 9 prevents printing ink 16 on the underside of the sheet 13 from being deposited on the surface of the cover 9.

Figure 4:
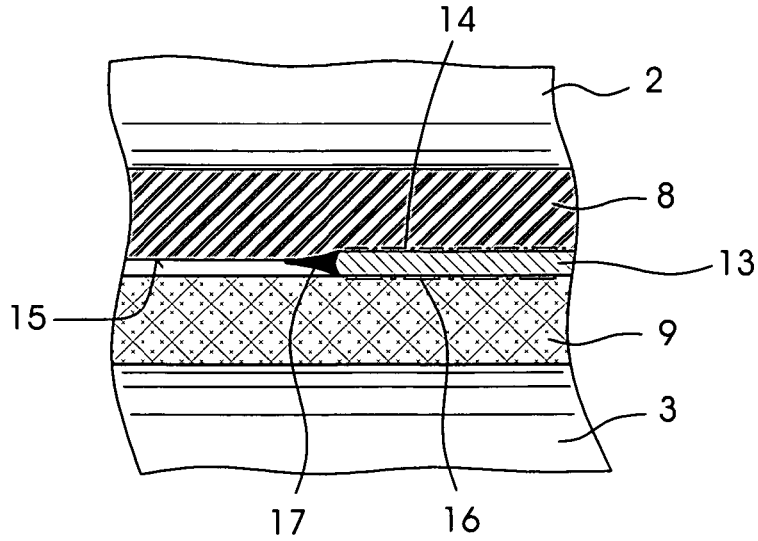
FIG. 4 is a section taken through a blanket cylinder having a paper edge streak.

As illustrated in more detail in FIG. 4, paper edge streaks 17 are formed on the jacket surface, i.e., the circumferential surface 15, at the marginal edges of the sheet 13 after a large number of prints. The paper edge streaks 17 are composed of a hardened mixture of paper particles and printing ink 14. In order to avoid damage to the ink-repelling surface of the cover 9, the paper edge streaks 17 must be removed regularly in a cleaning operation.

In order to eliminate the paper edge streaks 17 from the circumferential surface 15 of the blanket 8, the supply of sheets is stopped. As illustrated in FIG. 1, in a first step the paper edge streaks 17 are broken up. To this end, the blanket cylinder 2 is thrown off the impression cylinder 3 and thrown on to the plate cylinder 1. Furthermore, the ink applicator rolls 4 are thrown off the printing plate 7 and the dampening solution applicator rolls 5 are thrown on to the printing plate 7. While the plate cylinder 1 and the blanket cylinder 2 rotate, dampening solution/fountain solution originating from the storage container 12 is transferred via a dip roll 18, a dampening solution transfer roll 19, the dampening solution applicator rolls 5 and the printing plate 7 to the circumferential surface 15 of the blanket 8. There is pressure between the blanket cylinder 2 and the plate cylinder 1, so that the paper edge streaks 17 softened by the dampening solution are broken up. The adhesion of the paper edge streaks 17 to the circumferential surface 15 is so reduced in the process that it is possible to brush off the paper edge streaks 17.

The cleaning of the blanket 8 with the brush 10 is illustrated in more detail in FIG. 2. The dampening solution applicator roll 5 and the blanket cylinder 2 are thrown off the plate cylinder 1. The brush 10 is thrown on to the circumferential surface 15 and set into rotation. The paper edge streaks 17 and other contaminants pass into the doctor trough 11, from which they are led away out of the press.

Following the cleaning of the blanket 8, the surface of the cover 9 on the impression cylinder 3 is washed. As shown in more detail in FIG. 3, the ink applicator rolls 4, the dampening solution applicator rolls 5 and the blanket cylinder 2 remain thrown off the plate cylinder 1. The blanket cylinder 2 is thrown on to the impression cylinder 3. While the impression cylinder 3 and the blanket cylinder 2 rotate, printing ink and contaminants are transferred from the cover 9 to the blanket 8. By means of the brush 10, which continues to be thrown on to the circumferential surface 15, the printing ink and contaminants are removed.

The breaking up of the paper edge streaks 17 and the washing of the blanket 8 and of the cover 9 are carried out under program control. The parameters that are optimal for the program sequence, such as the rotational speed of the blanket cylinder 2, the rotational speed of the dip roll 18, the time during which the paper edge streaks 17 are broken up, the wetness of the brush 10 and the time of the brush action, are determined by trials and recorded in a memory of a computer.

Figure 5:
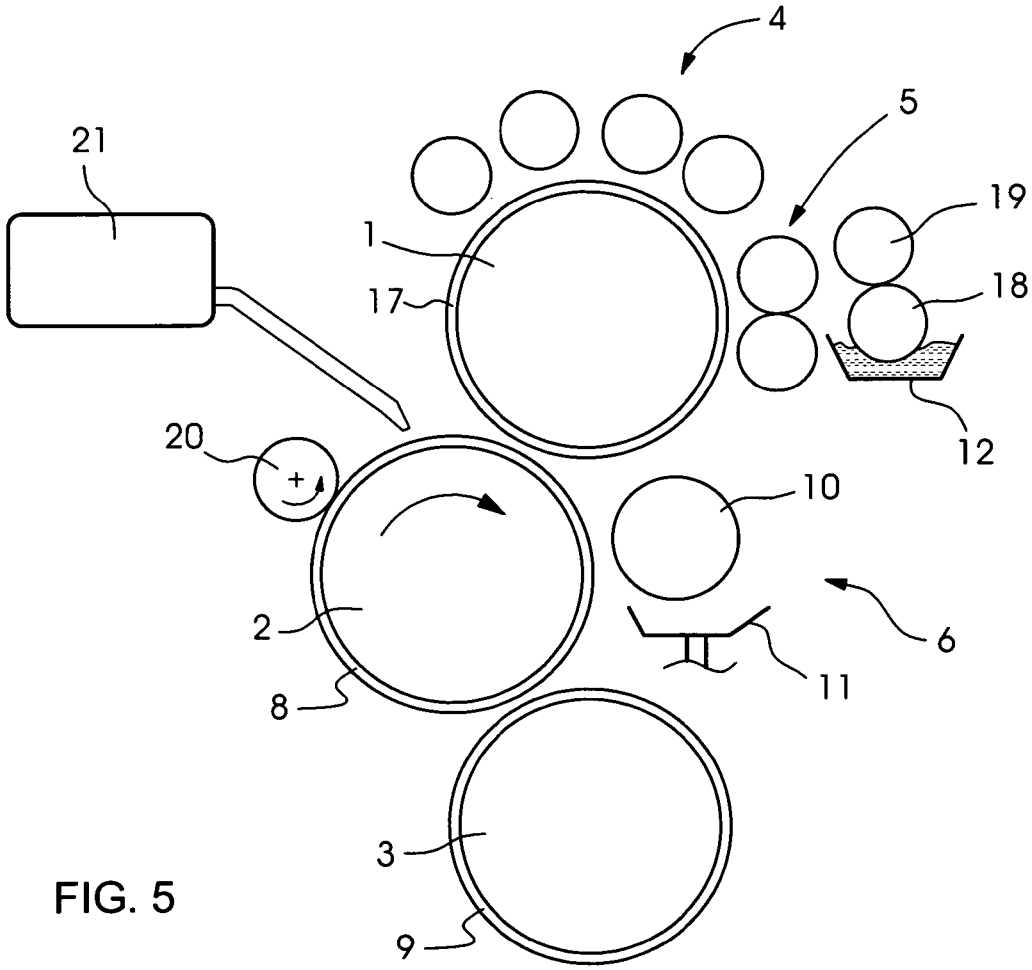
FIG. 5 is a schematic side view relating to breaking paper edge streaks with a breaker roll.

The invention is not restricted to the exemplary embodiment illustrated. Instead of the brush cleaning apparatus 6, a cloth washing device can be used as a washing apparatus for the blanket 8. Breaking up the paper edge streaks 17 can be done with a special breaker roll 20 which, as illustrated in FIG. 5, is thrown on to the circumferential surface 15. The breaker roll 20 has a hard, structured surface. Furthermore, the paper edge streaks 17 can be softened by means of a fluid, which is applied to the circumferential surface 15 by using a separate apparatus 21.

The invention claimed is:

1. A method for cleaning a circumferential surface of a transfer cylinder in a wet offset printing press having a printing plate for printing, the method which comprises:

printing by applying a dampening solution to the printing plate during printing;

applying a cleaning fluid being the dampening solution to the circumferential surface of the transfer cylinder;

subsequent to applying the cleaning fluid, removing contaminants from the circumferential surface of the transfer cylinder by:

mechanically breaking up the contaminants; and subsequently starting into operation a cleaning apparatus acting on the circumferential surface of the transfer cylinder.

2. The method according to claim 1, wherein the step of mechanically breaking up the contaminants includes rotating the transfer cylinder and throwing onto the circumferential surface of the transfer cylinder an adjacent, rotatable cylinder.

3. The method according to claim 1, wherein the step of breaking up the contaminants includes throwing a rotatable printing form cylinder with a printing form onto the circumferential surface of the transfer cylinder.

4. The method according to claim 1, wherein the step of breaking up the contaminants includes throwing a rotatable breaker roll on to the circumferential surface of the transfer cylinder.

5. The method according to claim 1, wherein the applying step includes applying the dampening solution to the circumferential surface of the transfer cylinder by a printing form cylinder having a printing form, which is thrown on to the circumferential surface of the transfer cylinder, and bringing the printing form into rolling contact with a dampening solution applicator roll of a dampening unit.

6. The method according to claim 1, wherein the cleaning apparatus includes a rotating brush.

7. The method according to claim 4, which comprises providing the breaker roll with a harder surface than a material on the circumferential surface of the transfer cylinder.

8. The method according to claim 4, which comprises providing a breaker roll with a structured surface.

9. A method for cleaning a circumferential surface of a transfer cylinder in a wet offset printing press having a printing plate for printing, the method which comprises:

printing by applying a fountain solution to the printing plate during printing;

subsequent to printing, cleaning by applying a cleaning fluid being the fountain solution to the circumferential surface of the transfer cylinder;

subsequent to applying the cleaning fluid, removing contaminants from the circumferential surface of the transfer cylinder by:

mechanically breaking up the contaminants; and subsequently starting into operation a cleaning apparatus acting on the circumferential surface of the transfer cylinder.

* * * * *